US007547858B2

(12) United States Patent
Nagata

(10) Patent No.: US 7,547,858 B2
(45) Date of Patent: Jun. 16, 2009

(54) PUSH BUTTON SWITCH

(75) Inventor: Kenshi Nagata, Kurayoshi (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/643,511

(22) Filed: Dec. 21, 2006

(65) Prior Publication Data

US 2007/0144875 A1 Jun. 28, 2007

(30) Foreign Application Priority Data

Dec. 26, 2005 (JP) ..... 2005-372675

(51) Int. Cl.
*H01H 5/18* (2006.01)

(52) U.S. Cl. ..... 200/520; 200/406

(58) Field of Classification Search ..... 200/520, 200/402, 406, 516, 517, 533, 535
See application file for complete search history.

(56) References Cited

U.S. PATENT DOCUMENTS 6,114,644 A * 9/2000 Nishikawa ..... 200/406
6,756,554 B1 * 6/2004 Hu ..... 200/406
7,022,928 B2 * 4/2006 Watanabe et al. ..... 200/406
2005/0029084 A1 * 2/2005 Watanabe et al. ..... 200/406

FOREIGN PATENT DOCUMENTS

JP 5-1126 1/1993
JP 5-83958 11/1993

* cited by examiner

*Primary Examiner*—Elvin G Enad
*Assistant Examiner*—Lheiren Mae A Anglo
(74) *Attorney, Agent, or Firm*—Osha • Liang LLP

(57) ABSTRACT

A push button switch has a housing formed by a base in which a fixed contact is disposed on a bottom face of the base and a cover assembled to the base, an operating member slidably inserted in the housing parallel to the bottom face of the base, a guiding part formed on the cover, extending obliquely inwards from a ceiling face of the cover, wherein a tip of an operating piece of the operating member is operable to slide along the guiding part, and a movable contact disposed in the housing and operable to be pressed against the fixed contact, thereby opening a circuit. The guiding part and a reinforcing part extending from the ceiling face of the cover at least on one side of the guiding part are formed at an edge of a through hole formed in the ceiling face of the cover. The movable contact has a thin dome shape.

10 Claims, 6 Drawing Sheets

PUSH BUTTON SWITCH

BACKGROUND OF THE INVENTION

1. Field of the Invention

The present invention relates to a push button switch and, more particularly, to a push button switch in which an operating member is inserted in the axial direction to open/close a contact.

2. Description of the Related Art

Hitherto, there is a push button switch in which an operating member assembled in a housing is pushed from a side to depress a movable contact to come into contact with a fixed contact, thereby opening/closing a circuit. For example, there is a push button switch in which a tilt piece 33 having a cantilever shape is cut from a center of the flat surface of a cover member 17 constructing a housing and an operating part 34 of an operating member 16 is pressed against the tilt piece 33, thereby depressing a movable contact 14 to open a circuit (refer to Japanese Unexamined Utility Model Publication No. Hei 5-83958).

There is another push button switch having a bent portion 35 in an almost V shape whose both ends are supported in a notch 34 in a pressing plate 33 as a component of a housing. By pressing a contact pressing portion 29 of an operating member 19 against the bent portion 35, a movable contact 18 is depressed to open a circuit (refer to Japanese Unexamined Utility Model Publication No. Hei 5-1126).

In the former push button switch, however, the tilt piece 33 has a cantilever shape, so that it tends to be elastic deformed. It is not easy to accurately push the movable contact, and the operation characteristics tend to vary.

In the latter push button switch, the bent portion 35 having an almost V shape whose both ends are supported has to be deep-drawn by press work. Consequently, the process face of the bent portion 35, in particular, the tilt surface with which the contact pressing portion 29 of the operating member 19 comes into press contact tends to become rough, and the operating member 19 sliding with the tilt surface wears easily, causing a problem such that the push button switch has short life.

The present invention has been achieved in view of the problems, and an object of the invention is to provide a long-life push button switch having no variations in its operation characteristics.

SUMMARY OF THE INVENTION

To solve the problem, a push button switch according to the present invention includes: a housing formed by a base in which a fixed contact is disposed on a bottom face and a cover assembled to the base; an operating member slidably inserted in the axial direction in the housing; a guiding part which is formed obliquely from a ceiling face of the cover to the inside and along which the tip of an operation piece of the operating member slides; and a movable contact housed in the housing and pressed against the fixed contact, thereby opening a circuit, and the guiding part along which the tip of the operating piece of the operating member can slide and a reinforcing part continued from the ceiling face of the cover at least on one side of the guiding part are formed at the edge of a through hole formed in the ceiling face of the cover.

According to the present invention, since the guiding part along which the operating member slides is reinforced by the reinforcing member, the guiding part is not easily elastic-deformed unlike the conventional technique, so that the movable contact can be pressed accurately. Thus, a push button switch having no variations in the operation characteristics can be obtained.

Since the guiding part and the reinforcing part are continuously provided at the edge of the through hole formed in the ceiling face of the cover, like the conventional technique, it is unnecessary to perform deep drawing. Consequently, roughening of the sliding face of the guiding part is suppressed, and the tip of the operating member that slides along the guiding part is not easily worn out, so that a long-life push button switch is obtained. In particular, by performing the press work so that roughening of the face is concentrated in the reinforcing part to avoid occurrence of roughening in the guiding part, a longer-life push button switch is obtained.

As an embodiment of the invention, a frame member having an almost U shape and extending from the operating member may be guided along a pair of guide ribs projected in parallel with each other along both sides of the top face of the base.

In the embodiment, both sides of the operating member are accurately guided by the pair of guide ribs provided for the base. Therefore, a push button switch having no variations in operation characteristics can be obtained.

DETAILED DESCRIPTION OF THE PREFERRED EMBODIMENTS

Figure 1:
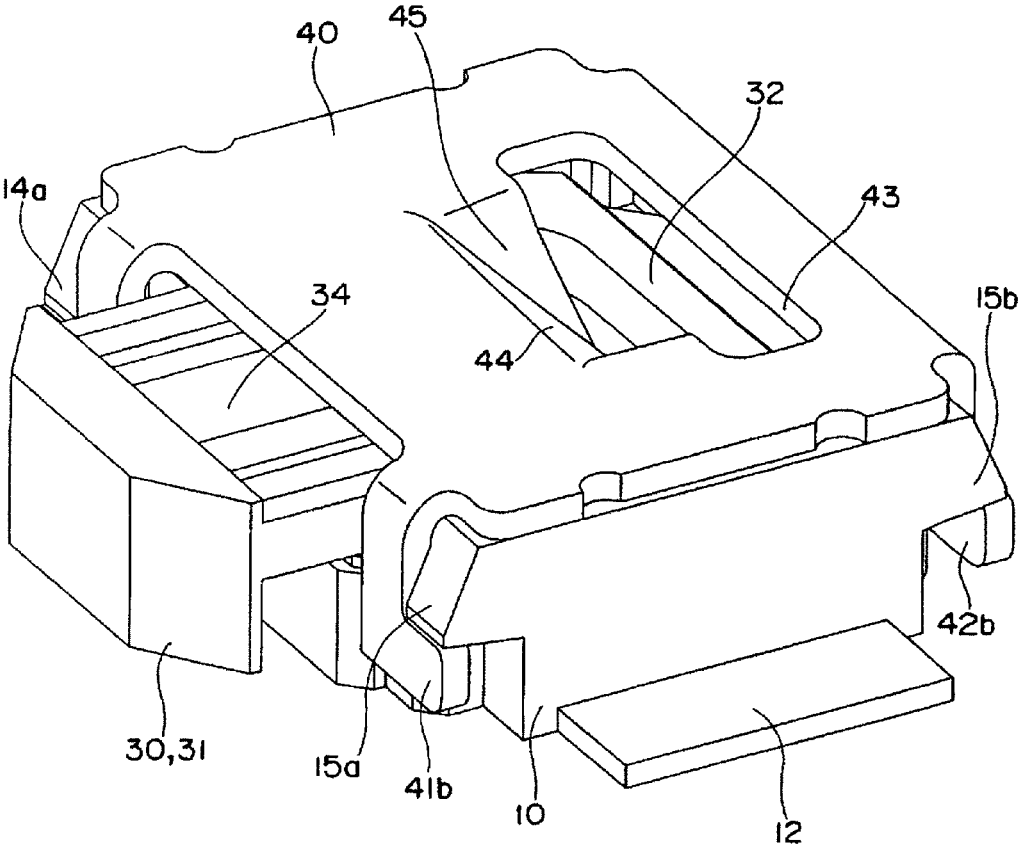
FIG. 1 shows a perspective view of an embodiment of a push button switch according to the present invention.
Figure 2:
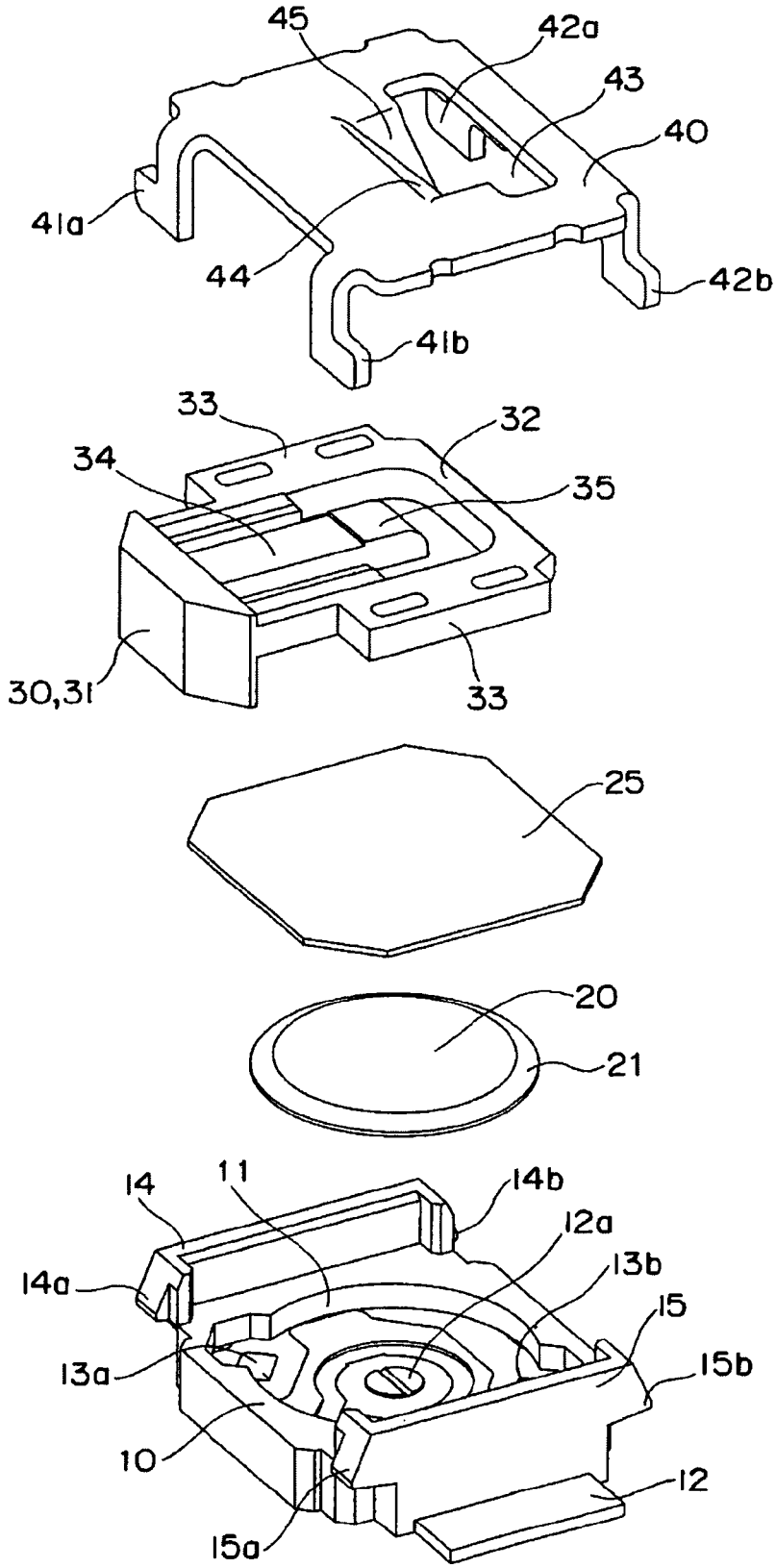
FIG. 2 shows an exploded perspective view of the push button switch illustrated in FIG. 1.
Figure 3:
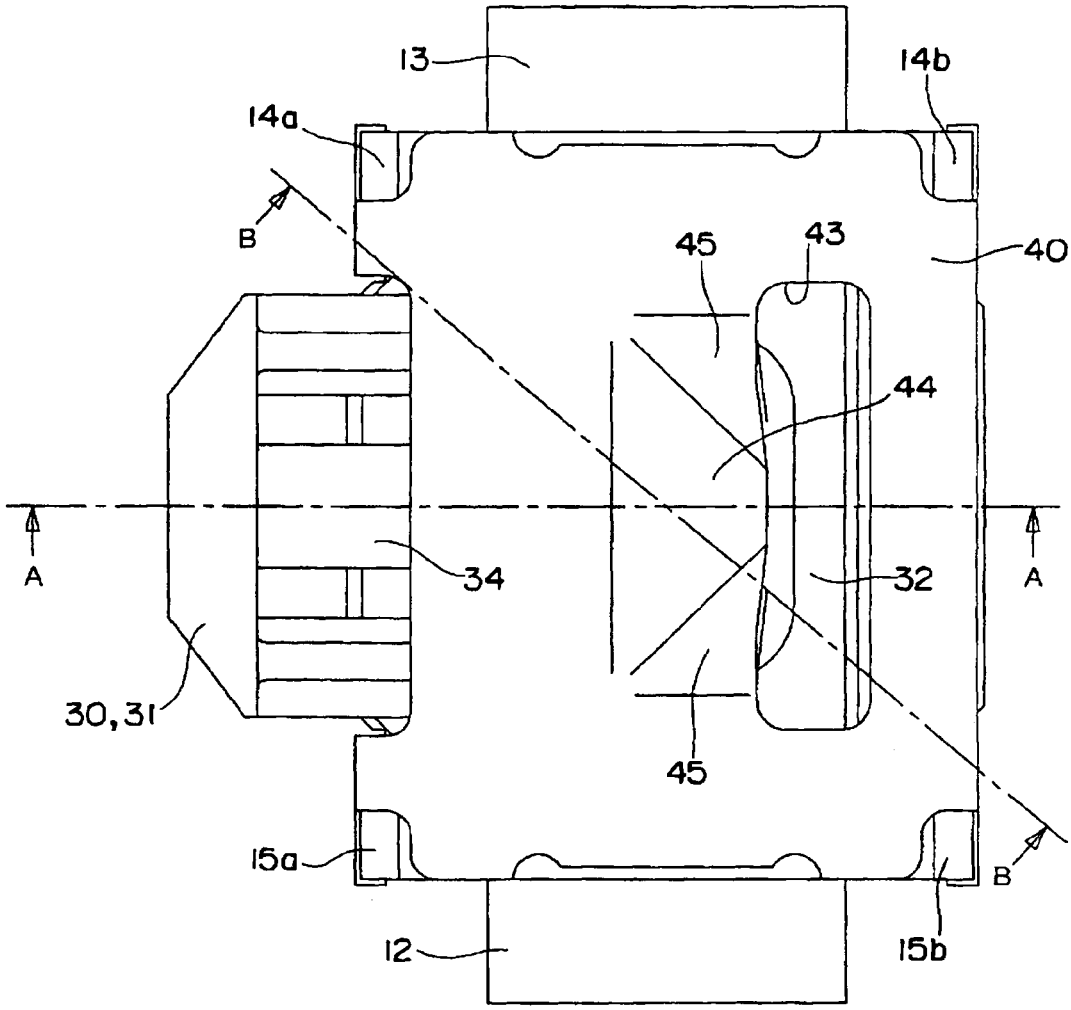
FIG. 3 shows a plan view of the push button switch illustrated in FIG. 1.

An embodiment of the present invention will be described with reference to the attached drawings of FIGS. 1 to 6.

A push button switch as an embodiment is constructed by a base 10, a movable contact 20, an insulating sheet 25, an operating member 30, and a cover 40.

A recess 11 having an almost circular shape in plan view is formed in the center of the top face of the base 10, a central fixed contact 12*a* conducted to a fixed contact terminal 12 is provided so as to project in the center of the bottom face of the recess 11, and a pair of fixed contacts 13*a* and 13*b* conducted to a fixed contact terminal 13 are disposed in opposite positions while sandwiching the central fixed contact 12*a*. Guide ribs 14 and 15 are provided so as to project at both facing sides of the top face of the base 10. Further, the guide rib 14 has engagement projections 14*a* and 14*b* at its ends, and the guide rib 15 has engagement projections 15*a* and 15*b* at its ends.

The movable contact 20 is made of an elastic conducting material and has a thin dome shape which can be fit in the recess 11 in the base 10. By fitting the movable contact 20 in the recess 11 in the base 10, an outer periphery 21 of the movable contact 20 comes into contact with the fixed contacts 13*a* and 13*b*.

The insulating sheet 25 has an almost quadrate shape capable of covering the plane of the base 10. By disposing the insulating sheet 25 between the guide ribs 14 and 15 of the base 10, the recess 11 is covered.

In the operating member 30, a frame member 32 having an almost U shape is integrally formed on one of faces of an operating part 31, and guide projections 33 and 33 are projected from facing side surfaces of the frame member 32. An operating piece 34 positioned in the frame body 32 is provided in the center of one of the surfaces of the operating part 31 so as to project to a side.

Figure 4A:
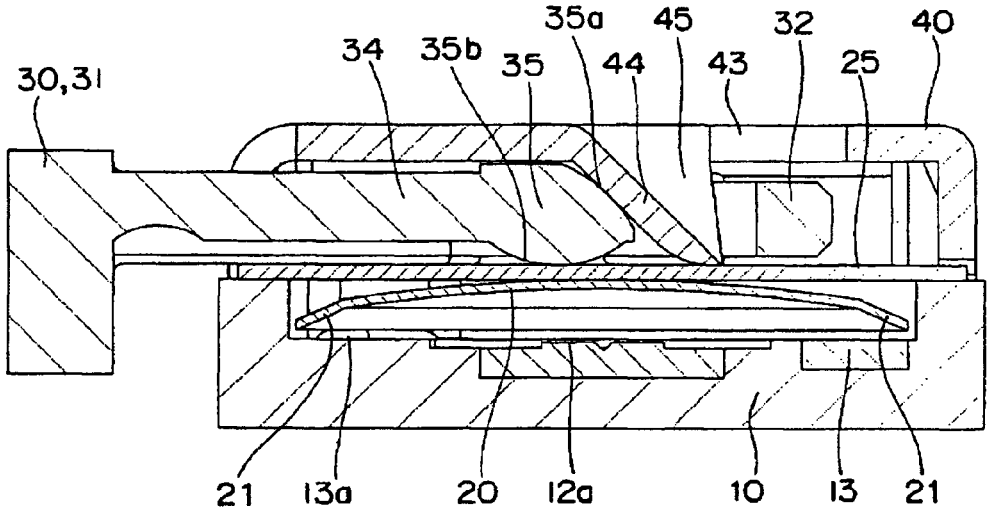
FIGS. 4A and 4B are cross sections taken along lines A-A and B-B, respectively, of FIG. 3.
Figure 4B:
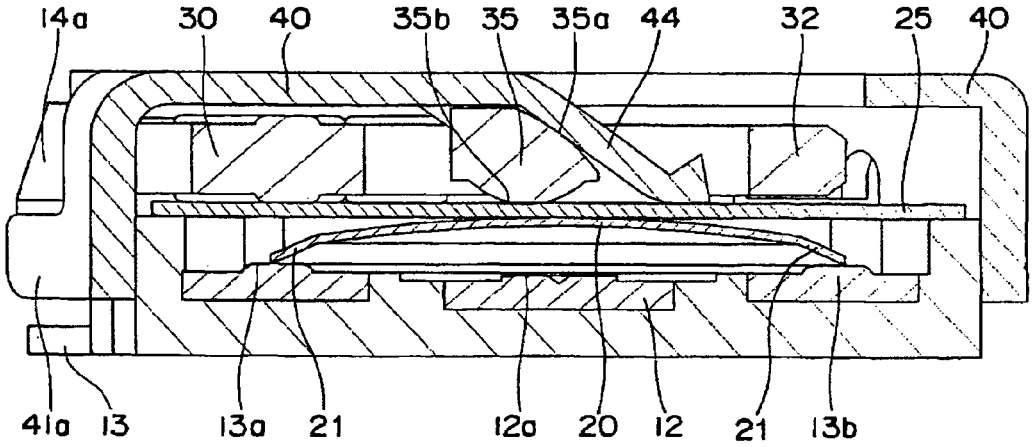
Figure 5:
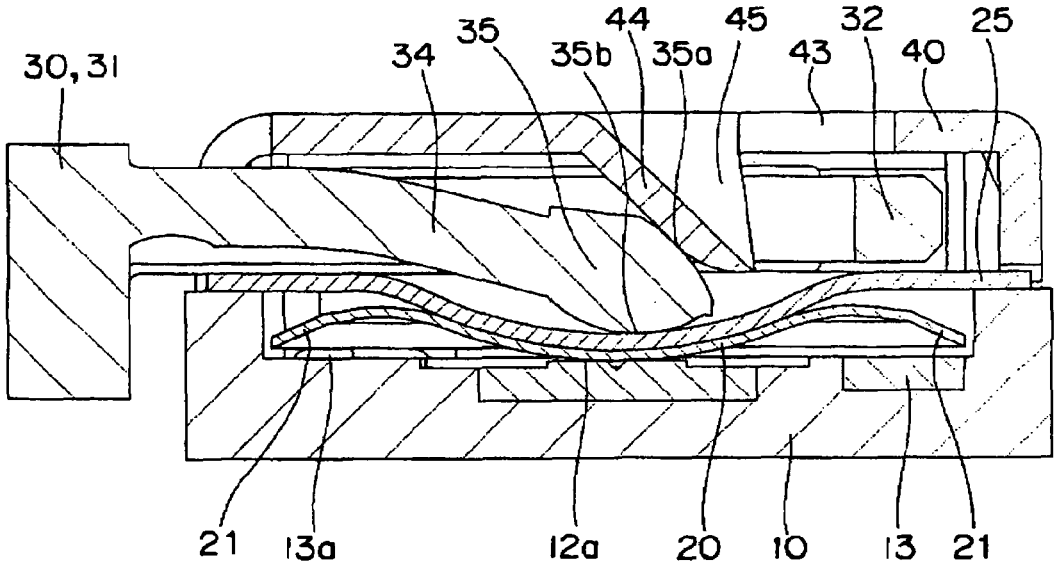
FIG. 5 shows a cross section illustrating an operation state.
Figure 6A:
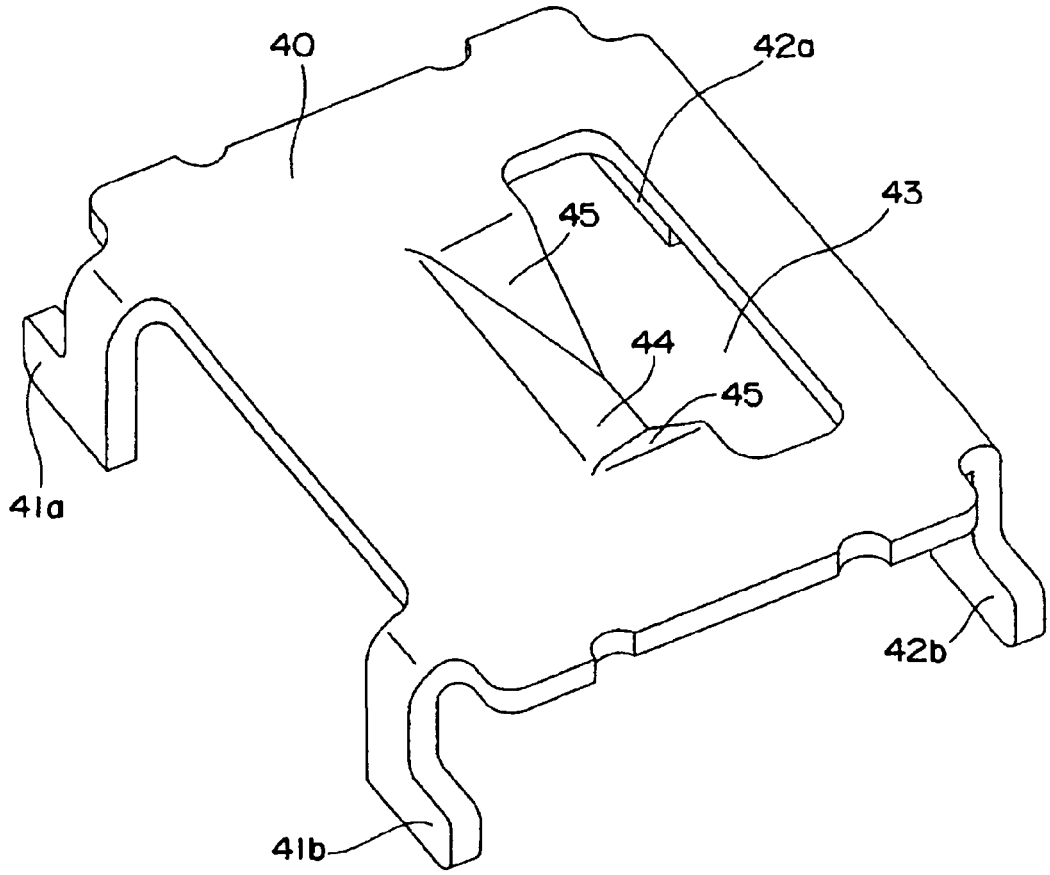
FIGS. 6A and 6B show perspective view and cross section, respectively, of a cover single body shown in FIG. 1.
Figure 6B:
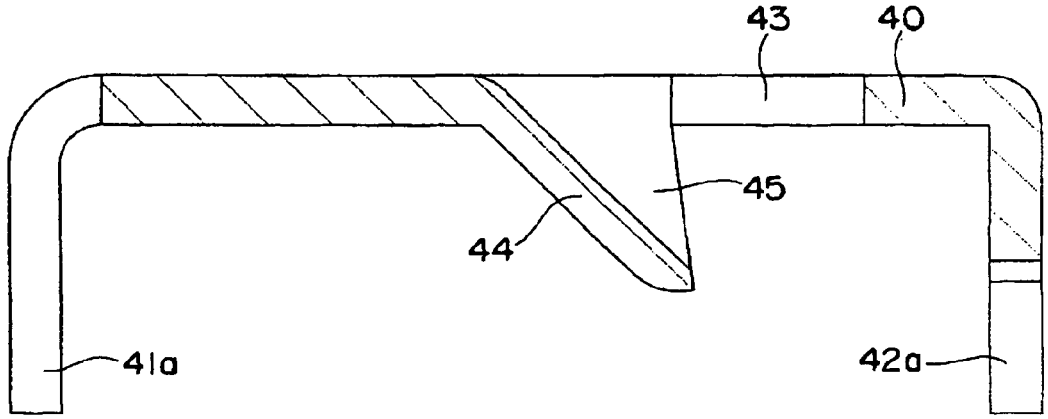

The frame member 32 of the operating member 30 is positioned between the guide ribs 14 and 15 of the base 10 and slidably assembled. Consequently, as shown in FIGS. 4A and 4B, an upper circular face 35*a* of the tip 35 of the operating piece 34 can come into contact with a guiding part 44 in the cover 40 which will be described later and a lower circular face 35*b* comes into contact to the movable contact 20 via the insulating sheet 25.

The cover 40 has a shape in plan view capable of covering the plane of the base 10. A pair of elastic engagement nails 41*a* and 41*b* and a pair of elastic engagement nails 42*a* and 42*b* of the cover 40 extend from both facing sides and are bent downward. In the cover 40, a through hole 43 having an almost rectangle shape is formed on one side of the plane and, by performing press work on a long side of the through hole 43, a guiding part 44 and reinforcing parts 45 and 45 on both sides of the guiding part 44 are formed.

When the cover 40 is attached to the base 10, the elastic engagement nails 41*a*, 41*b*, 42*a*, and 42*b* are elastically deformed to the outside and then come into engagement with the engagement projections 14*a*, 15*a*, 14*b*, and 15*b* of the base 10, respectively. Since the guiding part 44 of the cover 40 is positioned between the frame member 32 of the operating member 30 and the tip 35 of the operating piece 34, the operating member 30 is preventing from coming off.

A method of operating the push button switch having the above-described configuration will be described.

First, if it is before operation, as shown in FIG. 4A, the operating part 31 of the operating member 30 projects from the base 10. The upper circular face 35*a* of the tip 35 of the operating piece 34 is in contact with the under face of the guiding part 44, and the lower circular face 35*b* is in contact with the movable contact 20 via the insulating sheet 25. Further, the movable contact 20 is apart from the central fixed contact 12*a*.

When the operating part 31 of the operating member 30 is pushed, the guide projections 33 and 33 slide along the guide ribs 14 and 15. Consequently, the tip 35 of the operating piece 34 is pushed down along the guiding part 44, and the lower circular face 35*b* of the tip 35 pushes the center portion of the movable contact 20 down. When the center portion of the movable contact 20 is pushed down to a predetermined position and depressed, the movable contact 20 comes into contact with the central fixed contact 12*a*, and the central fixed contact 12*a* and the fixed contacts 13*a* and 13*b* are electrically connected. A narrow groove in an almost V shape in cross section is formed in the top face of the central fixing contact 12*a* in order to increase contact reliability.

After that, when the pressure applied on the operating member 30 is cancelled, the tip 35 of the operating piece 34 is pushed up by the spring force of the movable contact 20 and is pushed to a side by the horizontal component of the movable contact 20, and the operating member 30 returns to the original position. Since the frame member 32 is retained by the guiding part 44 and the reinforcing part 45, the operating member 30 does not come off from the base 10.

The push button switch according to the present invention is not limited to the configuration in which the reinforcing parts are provided on both sides of the guiding part of the cover but a reinforcing part may be provided only on one side of the guiding part.

What is claimed is:

1. A push button switch comprising:

a housing formed by a base in which a fixed contact is disposed on a bottom face of the base and a cover assembled to the base;

an operating member slidably inserted in the housing parallel to the bottom face of the base;

a guiding part formed on the cover, extending obliquely inwards from a ceiling face of the cover at an edge of a through hole formed in the ceiling face of the cover, wherein a tip of an operating piece of the operating member slides is operable to slide along the guiding part;

a movable contact disposed in the housing and operable to be pressed against the fixed contact, thereby opening a circuit; and a reinforcing part extending obliciuely inwards from the ceiling face of the cover at the edge of the through hole, wherein the guiding part and the reinforcing part are contiguous wherein the movable contact has a circular thin dome shape.

2. The push button switch according to claim 1, wherein a substantially U-shaped frame member extending from the operating member is guided along a pair of guide ribs projecting in parallel with each other along both sides of a top face of the base.

3. The push button switch according to claim 1, wherein an insulating sheet is disposed in the housing.

4. The push button switch according to claim 3, wherein the insulating sheet is disposed between the movable contact and the operating member.

5. The push button switch according to claim 4, wherein a substantially U-shaped frame member extending from the operating member is guided along a pair of guide ribs projecting in parallel with each other along both sides of a top face of the base.

6. The push button switch according to claim 3, wherein a substantially U-shaped frame member extending from the operating member is guided along a pair of guide ribs projecting in parallel with each other along both sides of a top face of the base.

7. A push button switch comprising:

a housing formed by a base in which a fixed contact is disposed on a bottom face of the base and a cover assembled to the base;

an operating member slidably inserted in the housing parallel to the bottom face of the base;

a guiding part formed on the cover, extending obliquely inwards from a ceiling face of the cover at an edge of a through hole formed in the ceiling face of the cover, wherein a tip of an operating piece of the operating member is operable to slide along the guiding part; and a movable contact disposed in the housing and operable to be pressed against the fixed contact, thereby opening a circuit;

a reinforcing part extending obliquely inwards from the ceiling face of the cover at the edge of the through hole, wherein the guiding part and the reinforcing are contiguous, wherein an insulating sheet is disposed in the housing, and wherein the movable contact has a circular thin dome shape.

8. The push button switch according to claim 7, wherein an insulating sheet is disposed in the housing between the movable contact and the operating member.

9. The push button switch according to claim 8, wherein a substantially U-shaped frame member extending from the operating member is guided along a pair of guide ribs projecting in parallel with each other along both sides of a top face of the base.

10. The push button switch according to claim 7, wherein a substantially U-shaped frame member extending from the operating member is guided along a pair of guide ribs projecting in parallel with each other along both sides of a top face of the base.

* * * * *

UNITED STATES PATENT AND TRADEMARK OFFICE

CERTIFICATE OF CORRECTION

PATENT NO. : 7,547,858 B2
APPLICATION NO. : 11/643511
DATED : June 16, 2009
INVENTOR(S) : Kenshi Nagata It is certified that error appears in the above-identified patent and that said Letters Patent is hereby corrected as shown below:

On the Title Page:

On the Cover Page, section (75) Inventor, the city "Kurayoshi" should read --Kurayoshi-shi--.

In the Claims:

In column 4, claim 1, line 20, the word "obliciuely" should read --obliquely--.

In column 4, claim 7, line 61, the words "obliquely inwards" should be removed.

Signed and Sealed this

Fourth Day of August, 2009

JOHN DOLL
*Acting Director of the United States Patent and Trademark Office*